US008032057B2

(12) United States Patent
Takahashi et al.

(10) Patent No.: US 8,032,057 B2
(45) Date of Patent: Oct. 4, 2011

(54) IMAGE FORMING APPARATUS

(75) Inventors: Yoshiharu Takahashi, Toyonaka (JP); Tadashi Okano, Hitachi (JP)

(73) Assignee: Ricoh Company, Ltd., Tokyo (JP)

( * ) Notice: Subject to any disclaimer, the term of this patent is extended or adjusted under 35 U.S.C. 154(b) by 873 days.

(21) Appl. No.: 12/048,846

(22) Filed: Mar. 14, 2008

(65) Prior Publication Data

US 2008/0226319 A1 Sep. 18, 2008

(30) Foreign Application Priority Data

Mar. 16, 2007 (JP) ..... 2007-068532

(51) Int. Cl.
*G03G 15/08* (2006.01)
*G03G 15/00* (2006.01)

(52) U.S. Cl. ..... 399/119; 399/107
(58) Field of Classification Search ..... 399/107, 399/119
See application file for complete search history.

(56) References Cited

U.S. PATENT DOCUMENTS 7,198,155 B2 4/2007 Otsuka
7,822,357 B2 * 10/2010 Kim ..... 399/106

FOREIGN PATENT DOCUMENTS

JP 2003195614 A * 7/2003
JP 2003327293 11/2003
JP 2006071671 3/2006

* cited by examiner

*Primary Examiner* — David Gray
*Assistant Examiner* — Andrew Do
(74) *Attorney, Agent, or Firm* — Oblon, Spivak, McClelland, Maier & Neustadt, L.L.P.

(57) ABSTRACT

An image forming apparatus including a plurality of developing devices each having a plurality of guide parts on both lateral sides, a frame body having a plurality of guide members configured to receive the guide parts of the developing devices, a front door for receiving and removing the developing devices from the frame body, and a position regulating member having a plurality of regulating parts and a connecting part configured to connect each regulating part, the position regulating member having an L-shape to regulate movement of the plurality of developing devices, each end of the regulating part configured to be placed between the guide part and the guide member, and the connecting part configured to be placed between the developing devices and the front door.

6 Claims, 6 Drawing Sheets

IMAGE FORMING APPARATUS

CROSS REFERENCE TO RELATED APPLICATIONS

This application is related to and claims priority under 35 U.S.C. §119 to Japanese Patent Application No. 2007-068532, filed on Mar. 16, 2007, the entire contents of which are hereby incorporated herein by reference.

BACKGROUND OF THE INVENTION

1. Field of the Invention

This present invention relates an image forming apparatus such as a printer or photo copier, and more particularly, relates to an image forming apparatus having a developing device.

2. Description of the Related Art

Conventionally, when an image forming apparatus such as a printer or a copier is transported with developing devices, the developing devices or the image forming apparatus might be destroyed by vibration or shock, for example, because the developing devices are not fixed to the image forming apparatus.

Consequently, the developing device and the image forming apparatus main body are packaged separately, without mounting the developing devices into the image forming apparatus.

In this case, if the apparatus main body and the developing device are packaged separately in one container box, the transport efficiency is reduced because the container box is larger, and the transport cost of the container box is increased.

Japanese Unexamined Patent Application Publication No. 2003-327293 describes an image forming apparatus which has a toner cartridge package inserted and fixed in a sheet storage space of an image forming apparatus main body. However, the image forming apparatus main body requires more space than provided by the sheet storage space when the toner cartridge package is for color printing. As a result, both the apparatus and the container box are much larger.

Japanese Unexamined Patent Application Publication No. 2006-71671 describes an image forming apparatus having a regulating member intervening between an apparatus body and a developing device when the image forming apparatus body is transported while mounting the developing device.

In the case where the developing device is mounted on the image forming apparatus main body by using a regulating member as disclosed by Japanese Unexamined Patent Application Publication No. 2006-71671, each developing device requires a regulating member when the image forming apparatus has plural developing devices for color printing. The plural regulating members are costly and provide a low degree of usability for user because of the increased work needed to remove the plural regulating members.

If the image forming is operated without removing a regulating member, the image forming apparatus main body, the developing device, or the regulating member may be broken by force during operation because the image forming apparatus was run while being loaded with a pressure of the regulating member.

Moreover, if a user removes the developing device from the image forming apparatus with the regulating member mounted between the image forming apparatus main body and the developing device, the main body, the developing member, or the regulating member may be damaged. This is because the regulating member is almost the same size as the mounting space, or slightly larger. Thus, it is not user-friendly.

A conventional apparatus has been constructed to disable itself without removing the regulating member by using a detecting part for the regulation member. However, this design has an increased cost because of the detecting part, etc.

SUMMARY OF THE INVENTION

In order to address these problems among others, a first object of the present invention is to provide an image forming apparatus including a plurality of developing devices each having a plurality of guide parts on both lateral sides; a frame body having a plurality of guide members configured to receive the guide parts of the developing devices; a front door for receiving and removing the developing devices from the frame body; and a position regulating member having a plurality of regulating parts and a connecting part configured to connect each regulating part, the position regulating member having an L-shape to regulate movement of the plurality of developing devices, each end of the regulating part configured to be placed between the guide part and the guide member, and the connecting part configured to be placed between the developing devices and the front door.

According to another embodiment, the image forming apparatus includes an L-shape position regulating member configured to be removed by removing at least one of the plurality of the developing devices.

According to another embodiment, the image forming apparatus includes a front door having a locking part configured to engage the L-shape position regulating member.

According to another embodiment, the image forming apparatus includes a position regulating member further having a position regulating member handle provided on the connecting part.

According to another embodiment, the image forming apparatus includes a plurality of regulating parts wherein at least one regulating part has a wedge shape.

DESCRIPTION OF THE INVENTION

Hereinafter, various embodiments of the invention are described with reference to the drawings.

An image forming apparatus in accordance with an embodiment is described with reference to FIG. 1.

Figure 1:
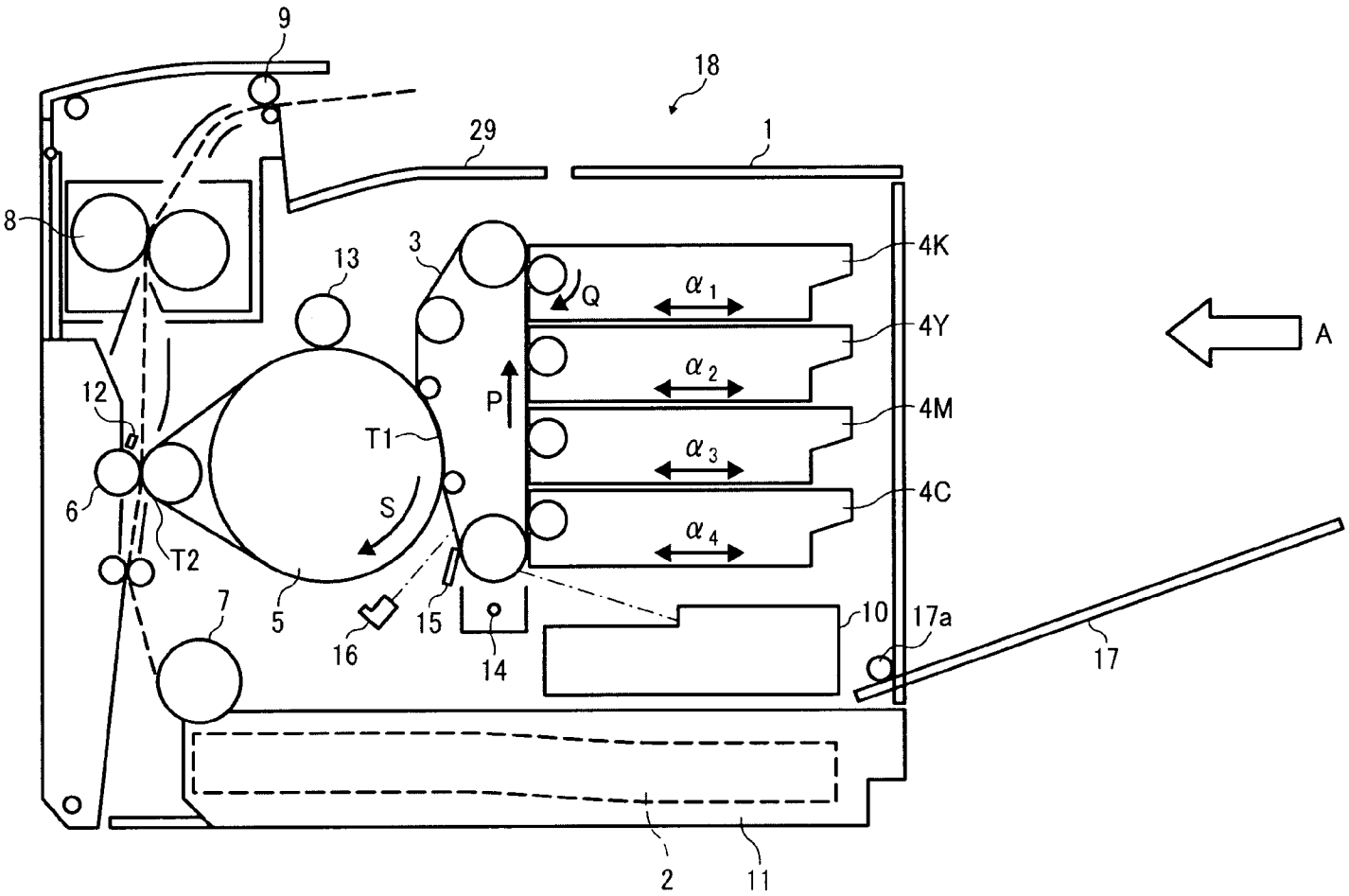
FIG. 1 is a cross-sectional view showing an image forming apparatus in accordance with an embodiment of the present invention.

FIG. 1 is a cross-sectional view of an image forming apparatus 18. A belt-shaped photo conductor 3 functioning as an image-supported member is being pulled in a vertical direction. On the right side of the belt-shaped photo conductor 3 illustrated in FIG. 1, developing devices 4K, 4Y, 4M and 4C enclosing, respectively, color toners, black, yellow, magenta and cyan are stacked vertically. On the left side of the belt-shaped photo conductor 3, an intermediate transfer device 5 having drums wrapped by a belt, a transfer device 6, a recording medium supplying device 7, a fuser 8, and a recording medium ejection device 9 are arranged. Under the developing device 4C, an exposure unit 10 configured to form an electrostatic latent image on the belt-shaped photo conductor 3 is provided. Under the exposure unit 10, a recording-medium storage unit 11 stores a recording medium 2. Around the intermediate transfer device 5, a recording medium separating unit 12 and an intermediate transfer device cleaning unit 13 are arranged. Around the belt-shaped photo conductor 3, a charger 14, an image-supported member cleaning unit 15, and a residual image eraser 16 are arranged. A front door 17 for removing the developing devices 4 is provided around the developing devices 4K, 4Y, 4M and 4C. A photo conductor door 29 for attaching and removing the photo conductor 3 is also provided.

Next, the behavior of the image forming apparatus 18 is described. First, the belt-shaped photo conductor 3 is rotated by a power source (not shown) in the direction of the arrow P shown in FIG. 1. The surface of the belt-shaped photo conductor 3 is charged uniformly by the charger 4. Next, the belt-shaped photo conductor 3 is exposed to image or character information from a personal computer, an image scanner, etc. in dot form by the exposure unit 10, and consequently, an electrostatic latent image is formed on the surface of the belt-shaped photo conductor 3. Then, a toner is supplied and developed by one of the developing devices 4K, 4Y, 4M and 4C, each moving in direction of arrow $\alpha 1$ to $\alpha 4$, respectively. The electrostatic latent image on the belt-shaped photo conductor 3 is developed as a toner image and is transferred to the first transfer point T1. On the first transfer point T1, the toner image is transferred to the surface of the intermediate transfer device 5 from the belt-shaped photo conductor 3 by a potential difference between the belt-shaped photo conductor 3 and the intermediate transfer device 5. After passing through the first transfer point T1, the electrostatic latent image on the surface of the belt-shaped photo conductor 3 is erased from the belt by dropping the potential of the photo conductor 3 below a constant electric potential by applying an optical irradiation using the residual image eraser 16. Residual toner which is not transferred to the belt-shaped photo conductor 3 at the first transfer point T1 is removed by the image-supported member cleaning unit 15. Thus, the surface of the belt-shaped photo conductor 3 is ready for forming the next toner image.

Alternatively, each developing device 4K, 4Y, 4M and 4C develops sequentially when the belt of the intermediate transfer device 5 goes into a 360-degree roll in the direction S. Full color toner images with superimposed plural color toner images are formed on the surface of the intermediate transfer device 5.

Here the recording medium such as paper, transparency sheet for overhead projection, etc., is transported to the second transfer point T2 by the recording medium supplying device 7. The single or multi color toner image formed on the surface of the intermediate transfer device 5 is transferred onto the recording medium 2 by the transfer device 6. Next, the recording medium 2 is separated from the intermediate transfer device 5 by the recording medium separating unit 12, the toner on the recording medium 2 is fixed by the fuser 8, and the recording medium 2 is transported outside the image forming apparatus 18 by the recording medium ejection device 9. The residual toner is removed by the intermediate transfer device cleaning unit 13. Thus, the surface of the intermediate transfer device 5 is ready for forming and superimposing the next toner images.

Figure 2:
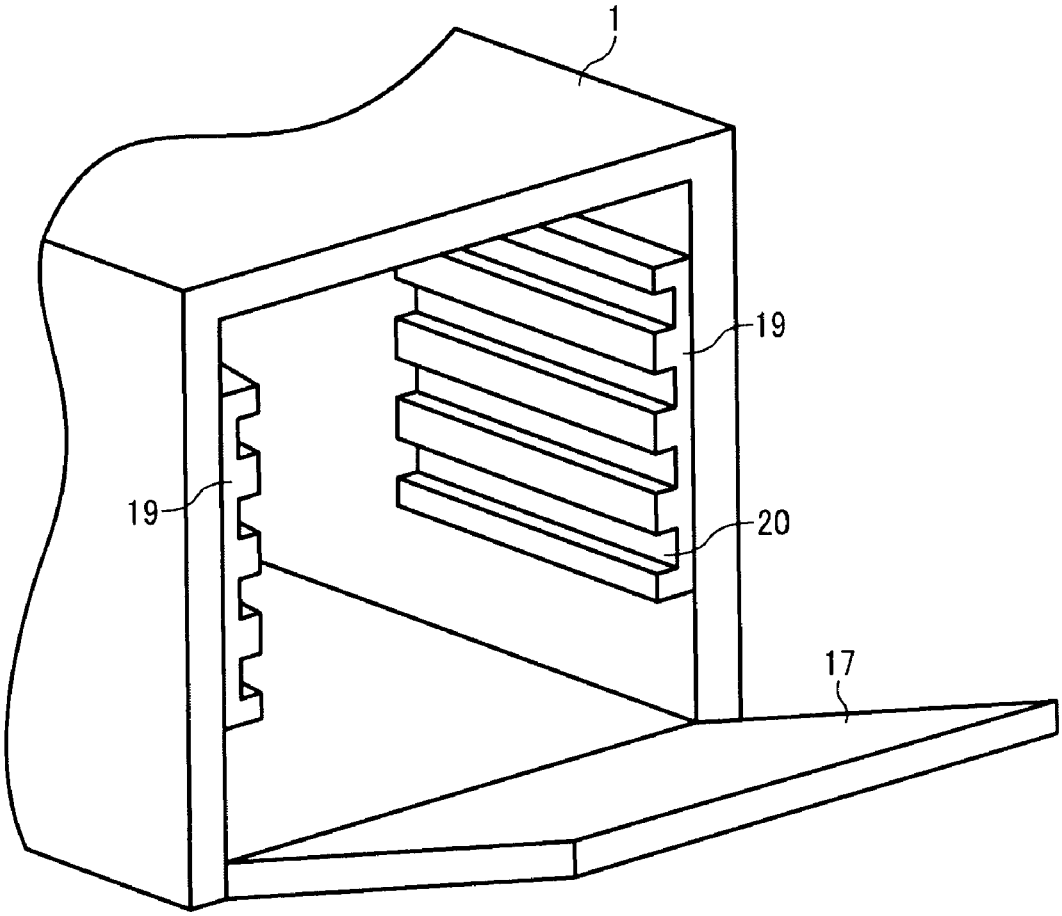
FIG. 2 is a partial schematic front perspective view showing an image forming apparatus without developing devices in accordance with an embodiment of the present invention.
Figure 3:
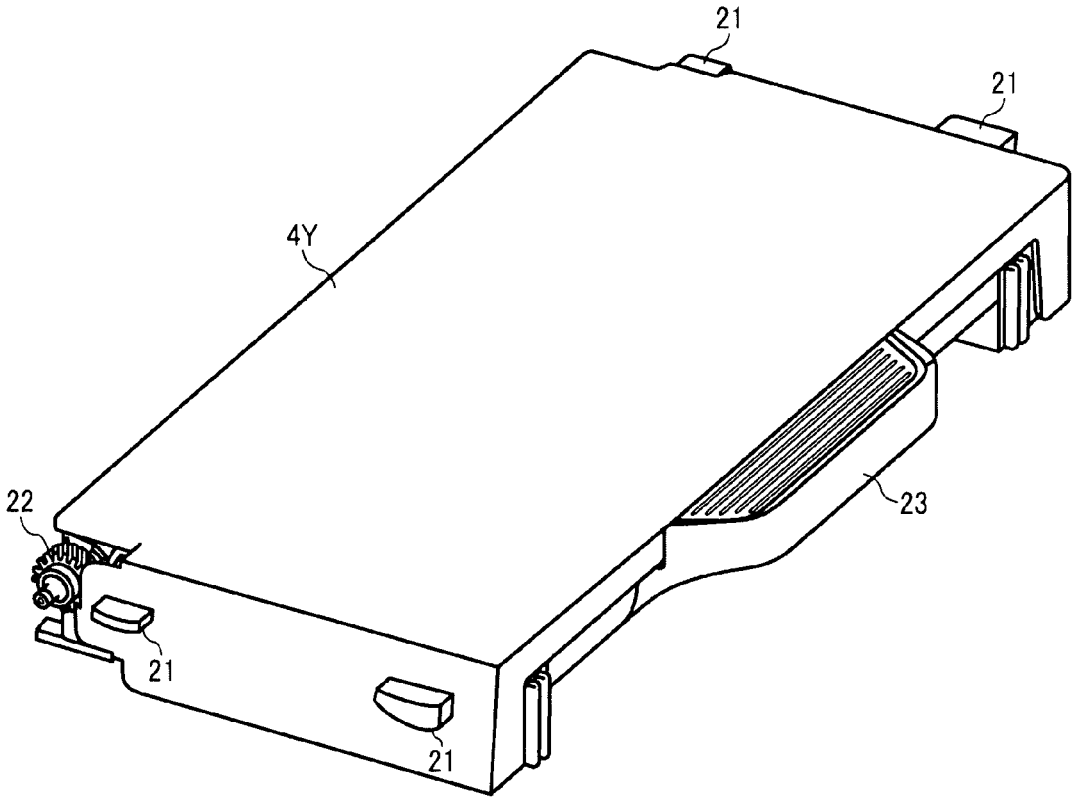
FIG. 3 is a perspective view of a developing device in accordance with an embodiment of the present invention.

Next, the behaviors and structures of a frame body 1 and the developing device 4 (4K, 4Y, 4M and 4C) in accordance with an embodiment of the invention are described with references to FIG. 2 and FIG. 3.

FIG. 2 is a partial schematic front perspective view of the image forming apparatus 18 having a front door 17 opened. The front door 17 is configured to swing on a hinge 17*a* connecting the front door 17 to the frame 1 body. When the front door 17 is opened, the main body of the image forming apparatus 18 can be seen as having a space for each of the developing devices 4K, 4Y, 4M and 4C. Two guide members 19 are placed on opposite sides of the developing devices 4. Each guide member 19 has guide troughs 20 for receiving the developing devices 4K, 4Y, 4M and 4C. These guide members 19 and guide troughs 20 function to guide each developing device to reciprocate for developing their respective colors.

FIG. 3 is a perspective view of the developing device 4Y. The following description regarding the developing device 4Y is applicable to the developing devices 4K, 4M and 4C. The developing device 4Y has a guide part 21 consisting of plural bosses on both lateral sides of the developing device 4Y as shown in FIG. 3, a gear 22 on the edge of the device, and a handle 23 on the back opposite side of the device (i.e., the front door 17 side) to make the developing device easier to attach and to remove. The gear 22 engages with a gear of a motor (a driving unit) on the main body 18 side of the image forming apparatus.

The behavior of the developing device 4Y is described below. The guide part 21 is guided by the guide troughs 20 and slides in the horizontal direction $\alpha 2$ by the gear 22 rotating and reversing. Thus, the developing device 4Y contacts and breaks off contact with the belt-shaped photo conductor 3. Consequently, the toner of the developing device 4Y is supplied onto the belt-shaped photo conductor 3, and a toner image can be formed on the belt-shaped photo conductor 3.

Next, the position regulating member 24 is described with references to FIG. 4, FIG. 5, FIG. 6 and FIG. 7.

Figure 6:
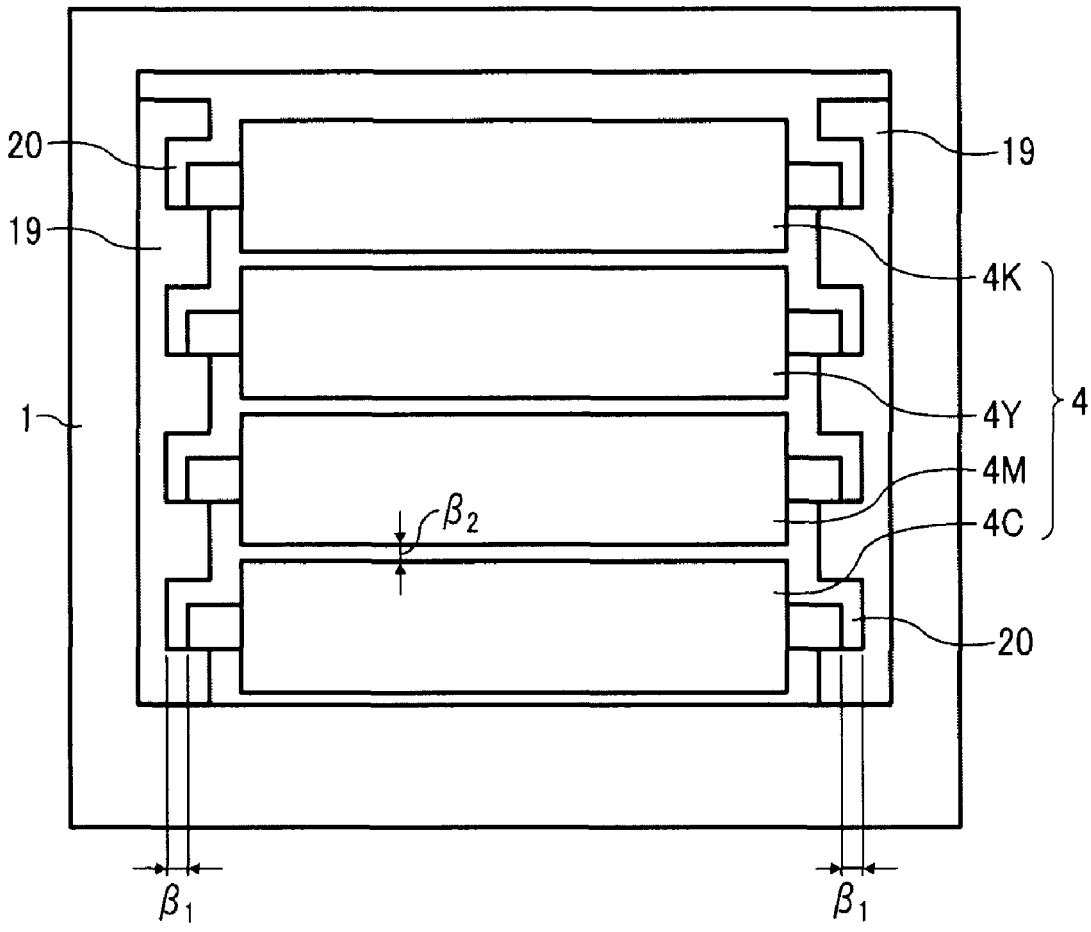
FIG. 6 is an elevation view of an image forming apparatus in accordance with an embodiment of the present invention.

FIG. 6 is an elevation view of the invention viewed along arrow A of FIG. 1.

Each developing device 4K, 4Y, 4M and 4C with the guide part 21 is guided by the guide troughs 20 and is inserted in the guide members 19 attached inside the image forming apparatus 18. There are gaps $\beta 1$ and $\beta 2$ for each developing device 4K, 4Y, 4M and 4C inserted in the image forming apparatus 18. The gap $\beta 1$ is a space between each developing device 4K, 4Y, 4M and 4C and each guide member 19 as shown in FIG. 6. The gap $\beta 2$ is a space between each developing device.

As described above with reference to FIG. 1, each developing device 4K, 4Y, 4M and 4C supplies toner to the belt-shaped photo conductor 3 by contacting the belt-shaped photo conductor 3 in the direction of arrow $\alpha 1$ to $\alpha 4$. Each gap $\beta 1$ is designed to keep the guide member 19 from coming in contact with each end-face of the guide part 21 placed on both lateral sides of the developing device 4. Each gap $\beta 1$ is approximately 1.3 mm in this embodiment.

Each gap β2 is designed so that each developing device 4K, 4Y, 4M and 4C can move alone without contacting each developing device 4. Each gap β2 is approximately 2.0 mm in this embodiment.

If developing devices 4 are mounted in the image forming apparatus 18 for transportation of the image forming apparatus 18, developing devices 4 may destroy the image forming apparatus 18 or may be broken by vibration or impact during the transportation process. Or, the developing device 4 may be shifted though not destroyed, resulting in destruction of the image forming apparatus 18 when the developing device 4 is pulled out.

According to this embodiment of the present invention, the position regulating member 24 is inserted in the guide troughs 20 between the guide part 21 of the developing device 4K, 4Y, 4M and 4C and the guide member 19 of the image forming apparatus 18 main body to prevent the image forming apparatus 18 mounted with the developing device 4 from being destroyed during a transportation process.

Figure 4:
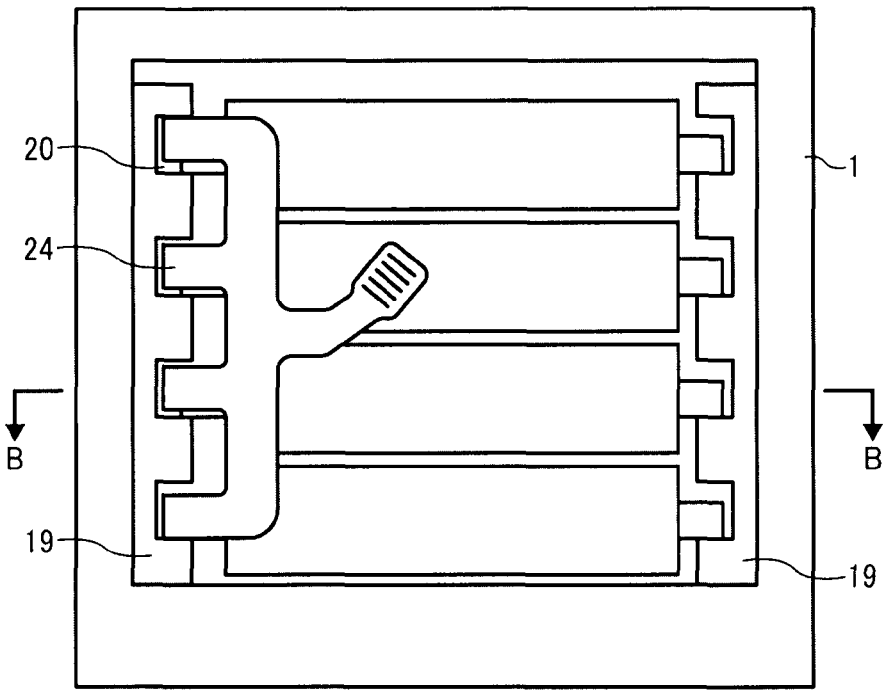
FIG. 4 is an elevation view showing an image forming apparatus having a position regulating member asserted therein in accordance with an embodiment of the present invention.
Figure 5:
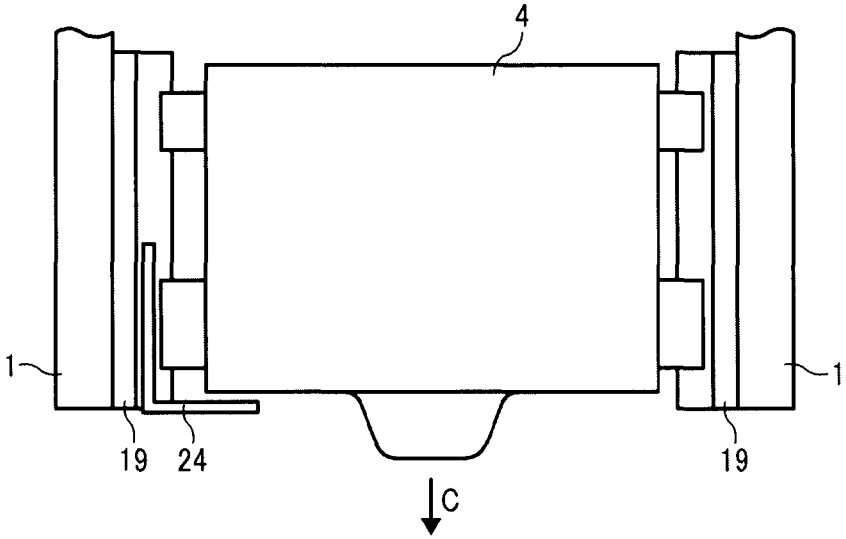
FIG. 5 is a schematic cross-sectional view of the image forming apparatus taken along the line B of FIG. 4.
Figure 7:
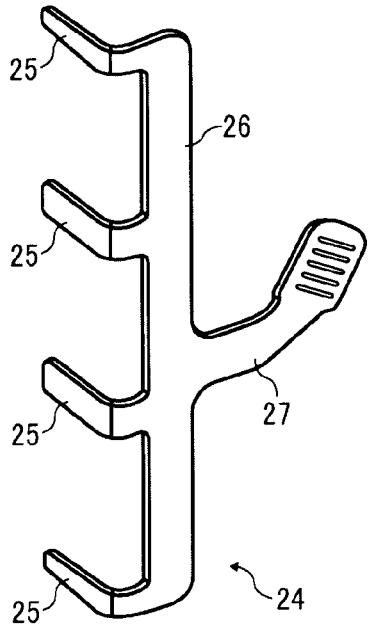
FIG. 7 is a perspective view of a position regulating member in accordance with an embodiment of the present invention.

FIG. 4 is an elevation view showing the image forming apparatus having the position regulating member 24 inserted therein. FIG. 5 is a schematic cross-sectional view of the image forming apparatus taken along the line B of FIG. 4. As shown in FIG. 7, the position regulating member 24 has a plurality of regulating parts 25. Each regulating part 25 is inserted within the gap β1 as shown in FIG. 6, or between the guide part 21 of the developing devices 4K, 4Y, 4M and 4C and the guide troughs 20. Thus, the thickness of the regulating part 25 is thinner than β1. For example, a thickness of the regulating part 25 is 1.8 mm at the end.

As shown in FIG. 5, it is preferred that a cross-section shape of the position regulating member 24 in the cross-section B is L-shaped. Thus, one end of the L-shaped position regulating member 24 is placed in each guide trough 20. The other end of the regulating member 24 is placed between the front door 17 and the handle 23 of the developing devices 4K, 4Y, 4M and 4C.

In this configuration, instead of removing the position regulating member 24 by hand directly, by withdrawing at least one of the developing devices 4 in the direction of arrow C in FIG. 5, the position regulating member 24 will be moved with the developing device 4 and will be pulled away from the image forming Apparatus 18. Therefore, when the image forming apparatus 18 is set up before printing, the position regulating member 24 can be easily removed. Thus, it is user-friendly.

Next, the shape of the position regulating member 24 is explained using the perspective view of the position regulating member 24 of FIG. 7. The position regulating member 24 includes plural regulating parts 25, a connecting part 26, and a position regulating member handle 27. In a preferred embodiment, parts of 25, 26 and 27 are formed together (i.e., integrated), there are four regulating parts 25, and the tip of each regulating part 25 has a wedge shape which is thin expanding toward the back end (the side of front door 17 when the regulating part 25 is mounted). The position regulating member handle 27 has plural convex portions on both front and back surfaces. It is preferred that the number of regulating parts 25 are selected in view of the number of developing devices.

The position regulating member 24 can regulate the movement of the developing devices 4K, 4Y, 4M and 4C in both horizontal and vertical directions in FIG. 2 by placing each regulating part 25 between the guide member 19 and the guide part 21. Thus, the position regulating member 24 can prevent both the image forming apparatus 18 main body and the developing devices 4K, 4Y, 4M and 4C from being destroyed. Further, at least one of the regulating parts 25 can have a wedge shape. See the top and bottom regulating parts 25 of FIG. 7. The wedge shape can increase the ease of insertion when the position regulating member 24 is loaded within the image forming apparatus 18.

By arranging the connecting part 26 with a plurality of regulating parts 25, costs can be reduced since each position regulating member will not have to be loaded individually for each developing device 4K, 4Y, 4M and 4C. That is, the regulating parts 25 can be pulled out together from between the guide troughs 20 and each guide part 21 instead of being pulled out individually. Thus, the connecting part 26 helps remove the position regulating member 24 without taking additional time or wasting energy. Moreover, by forming the position regulating member 24 as an integrated device, the device can be light-weight and have a low-price.

By placing plural convex portions on the surface and/or reverse side of the position regulating member handle 27, the user's grasp of the position regulating member 24 can be improved facilitating mounting and removing.

The position regulating member 24 is made of a softer resin than the guide member 19 or the housing of developing devices 4. This prevents the image forming apparatus 18 or the developing device from being damaged by vibration or impact. According to one embodiment, the material of the position regulating member 24 is a polypropylene. The material is not limited to resin. It is preferred, however, that material softer than the guide member 19 or the housing of developing devices 4, for example, foam material, etc., be used.

Generally, the user sets up the image forming apparatus 18 according to instructions provided with the apparatus. However, if the user operates the image apparatus 18 without reading the instructions, the user likely will not recognize that the position regulating member 24 has not been removed because the position regulating member 24 is located within the image forming apparatus 18. According to this invention, the image forming apparatus 18 will not be broken if the user removes the position regulating member 24. Moreover, a detecting unit for the position regulating member 24 is not needed. This is explained in more detail below.

If the image forming apparatus 18 is switched ON without removing the position regulating member 24, the printed image is distorted. Thus, the user will recognize an error because of the distorted image. The distortion occurs because the position regulating member 24 is between the front door 17 and each developing device 4K, 4Y, 4M and 4C, and consequently, each developing device 4K, 4Y, 4M and 4C cannot move as designed.

In response to the distortion, the user will open the front door 17 to inspect the developing device 4 and will notice that the position regulating member 24 has not bee removed. Next, the user will remove the position regulating member 24 using the handle 23. Otherwise, the user will remove at least one of the developing devices 4 as described above in conjunction with FIG. 2 so the position regulating member 24 can easily be pulled out from the image forming apparatus 18 without contacting the position regulating member 24.

Therefore, in this embodiment, if the image forming apparatus 18 activates without the position regulating member 24 being removed, the position regulating member 24 will be removed by the user after recognizing the error. Thus, the image forming apparatus 18 will not run continuously with the position regulating member 24 loaded. Thus, the image forming apparatus 18, the developing device 4, and the position regulating member 24 will be prevented from being damaged by power generated from operation of the device.

Figure 8:
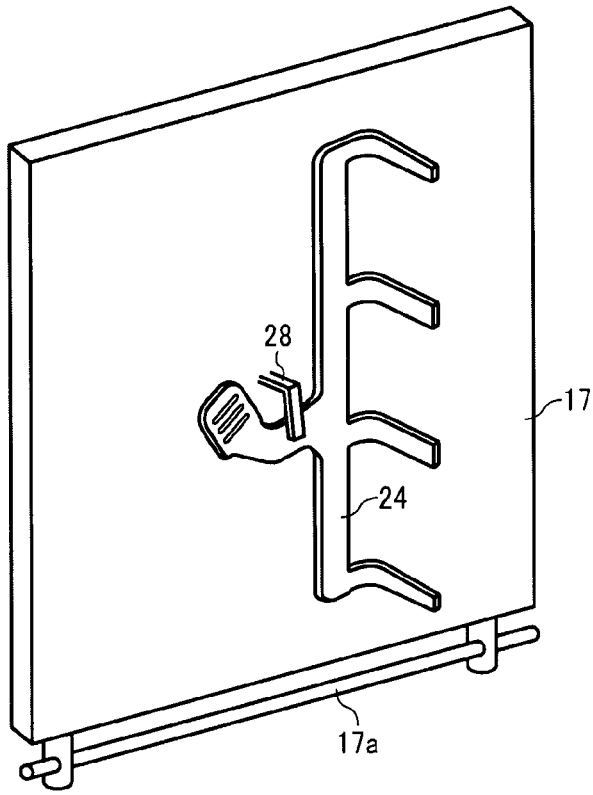
FIG. 8 is a schematic perspective view showing a front door with a locking protrusion part in accordance with another embodiment of the present invention.

Another embodiment of the invention is described with reference to FIG. 8. The basic construction of the image forming apparatus 18 in this embodiment is the same as the embodiment described above. Therefore, only the distinctive feature of this embodiment will be described. FIG. 8 is a view of the front door 17 with the position regulating member 24 hooked thereto.

A locking protrusion part 28 is placed inside the front door 17 (inside the image forming apparatus 18) to hook the position regulating member 24. Thus, when the front door 17 is opened with the position regulating member 24 hooked thereto, the position regulating member 24 is removed from the image forming apparatus 18 by the locking protrusion part 28.

Therefore, by simply opening the front door 17, the position regulating member 24 is removed without the user having to remember to remove the position regulating member 24. Thus, this is more user-friendly for users.

Obviously, numerous modifications and variations of the present invention are possible in light of the above teachings. It is therefore to be understood that within the scope of the appended claims, the invention may be practiced otherwise than as specifically described herein.

The invention claimed is:

1. An image forming apparatus comprising:

a plurality of developing devices each having a plurality of guide parts on both lateral sides;

a frame body having a plurality of guide members configured to receive the guide parts of the developing devices;

a front door for receiving and removing the developing devices from the frame body; and a position regulating member having a plurality of regulating parts and a connecting part configured to connect each regulating part, the position regulating member having an L-shape to regulate movement of the plurality of developing devices, each end of the regulating part configured to be placed between the guide part and the guide member, and the connecting part configured to be placed between the developing devices and the front door.

2. The image forming apparatus according to claim 1, wherein the L-shape position regulating member is configured to be removed by removing at least one of the plurality of the developing devices.

3. The image forming apparatus according to claim 2, wherein the front door further includes a locking part configured to engage the L-shape position regulating member when the door is opened.

4. The image forming apparatus according to claim 1, wherein the position regulating member further includes a position regulating member handle on the connecting part.

5. The image forming apparatus according to claim 1, wherein at least one of the regulating parts has a wedge shape.

6. An image forming apparatus comprising:

a plurality of developing devices each having a plurality of guide parts on both lateral sides;

a frame body having a means for receiving guide parts of the developing devices;

a front door for receiving and removing the developing devices from the frame body; and means for regulating movement of the plurality of developing devices, for being placed between the guide part and the means for receiving the guide part, and for being placed between the developing devices and the front door.

* * * * *